US008602839B2

(12) United States Patent
Tanaka et al.

(10) Patent No.: US 8,602,839 B2
(45) Date of Patent: Dec. 10, 2013

(54) EYEGLASS LENS PROCESSING DEVICE

(75) Inventors: Motoshi Tanaka, Aichi (JP); Kyoji Takeichi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 348 days.

(21) Appl. No.: 13/027,542

(22) Filed: Feb. 15, 2011

(65) Prior Publication Data

US 2011/0201255 A1 Aug. 18, 2011

(30) Foreign Application Priority Data

Feb. 15, 2010 (JP) ..... 2010-030723

(51) Int. Cl.
*B24B 49/00* (2012.01)
*B24B 51/00* (2006.01)

(52) U.S. Cl.
USPC ..... 451/5; 451/8; 451/43; 451/66

(58) Field of Classification Search
USPC ..... 451/5, 8, 10, 43, 44, 58, 65, 66, 67, 71, 451/255, 256, 384, 390; 700/164
See application file for complete search history.

(56) References Cited

U.S. PATENT DOCUMENTS 6,099,383 A * 8/2000 Mizuno et al. ..... 451/5
6,641,460 B2 * 11/2003 Obayashi ..... 451/5
6,702,653 B2 * 3/2004 Shibata ..... 451/42
7,510,459 B2 * 3/2009 Yamamoto ..... 451/6
7,611,243 B2 * 11/2009 Takeichi ..... 351/178
8,157,618 B2 * 4/2012 Shibata ..... 451/43
8,172,640 B2 * 5/2012 Tanaka et al. ..... 451/5
2004/0192170 A1 9/2004 Mizun
2007/0226991 A1 10/2007 Matsuyama
2009/0176442 A1 7/2009 Takeichi et al.
2010/0105293 A1 4/2010 Hamanaka et al.

FOREIGN PATENT DOCUMENTS

JP 2004-255561 A 9/2004
JP 2006-334701 A 12/2006
JP 2007-275998 A 10/2007
JP 2009-136969 A 6/2009
WO 2008-114781 A1 9/2008

* cited by examiner

*Primary Examiner* — Timothy V Eley
(74) *Attorney, Agent, or Firm* — Sughrue Mion, PLLC

(57) ABSTRACT

An eyeglass lens processing apparatus includes: a marking unit forming a mark on a lens; a mark position detector detecting a position of the mark; a controller performing roughing process and finishing process after the roughing process; and a positional deviation detector detecting a rotational deviation of the lens after the roughing process. The controller obtains a roughing path which allows, even if the lens rotates with respect to the lens chuck shafts by an angle at the time of the roughing process, the controller to perform the finishing process. The controller obtains an area in a process in which the mark and the target lens shape rotate on a chuck center of the lens chuck shafts by the angle, and computes the roughing path based on the area. The controller performs the roughing process based on the roughing path.

20 Claims, 10 Drawing Sheets

EYEGLASS LENS PROCESSING DEVICE

BACKGROUND

The disclosure relates to an eyeglass lens processing device for processing a periphery of an eyeglass lens.

An eyeglass lens processing device includes: a chuck mechanism having a pair of lens chuck shafts which hold an eyeglass lens and chucking an eyeglass lens with a predetermined chuck pressure; a chuck shaft rotating mechanism rotating about the lens chuck shaft; and a roughing tool and a finishing tool processing a periphery of a lens, and processes the periphery of a lens using the roughing tool and the finishing tool based on input target lens shape data (refer to, for example, JP-A-2004-255561 (US2004192170 A1), JP-A-2006-334701, JP-A-2009-136969 (US2009176442 A1), and Pamphlet of International Publication WO. 2008/114781 (US 2010105293 A1))

SUMMARY

Recently, a water repellent lens obtained by coating the surface of an eyeglass lens with a water repellent material to which water, oil, or the like is not easily attached is widely used. The surface of the water repellent lens is slippery. Therefore, particularly during the roughing process in which processing load is greatly applied, sliding occurs between a cup of a processing jig attached to the lens surface through an adhesive tape or the like and the lens surface, and as a result, "rotational deviation" (so-called axial deviation), the deviation of actual lens rotation angle from the rotation angle of the lens chuck shaft, is prone to occur.

In a case where the cup is attached such that the chuck center of lens chuck shaft is not positioned in the optical center of the lens, for instance, in a case where the cup is attached to the geometric center (so-called frame core) of the target lens shape, when a lens pressing member of one side of the lens chuck shaft contacts the rear surface of the lens, the lens pressing member does not evenly touch the curve on the rear surface of the lens, and lens is chucked by lopsided pressure. Accordingly, in the water repellent lens having a slippery lens surface, "lateral deviation" in which the chuck center of lens laterally deviates during the chucking of lens occurs too.

Occurrence of "positional deviation" such as "rotational deviation" or "lateral deviation" (as a term including both the "rotational deviation" and "lateral deviation", "positional deviation" is used in the present specification) decreases when treated is performed using the method disclosed in, for example, JP-A-2004-255561 and JP-A-2006-334701. However, when Leap tape (a double-sided tape) having weak adhesive power is used to attach the cup to the lens surface, it is increasingly likely that the "positional deviation" will occur. If the periphery of the lens is processed to a final finishing shape in the state of the "positional deviation", it is difficult to use the resultant lens.

International Publication WO. 2008/114781 attempts to enable processing by correcting the "rotational deviation" without devising prevention measures for the "rotational deviation". However, in this method, since an operator puts a mark for measuring the "rotational deviation" and takes a lens out of a processing device to check the "rotational deviation", it is burdensome to the operator, and lens processing becomes inefficient.

One aspect of the disclosure is to solve the above problems in the related art, and a technical object thereof is to provide an eyeglass lens processing device which can reduce the possibility that lens cannot be used, even when the "positional deviation" occurs in the lens. Another technical object is to provide an eyeglass lens processing device which can perform the processing efficiently by lightening an operator's burden in checking the occurrence of "positional deviation". The other object is to provide an eyeglass lens processing device which can efficiently perform the processing of a lens where the "positional deviation" is corrected and the processing of a lens where the "positional deviation" does not occur, while lightening an operator's burden.

In order to resolve the above problems, the aspect of the disclosure provides the following arrangements.

(1) An eyeglass lens processing apparatus for processing a periphery of an eyeglass lens, comprising:

a pair of lens chuck shafts configured to chuck the lens;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit including a mark position inputting unit configured to input an initial position of a mark to be formed on the lens;

a mark position detector configured to detect a position of the mark formed on the lens;

a controller configured to control the periphery processing tool to perform roughing process on the lens using the roughing tool and finishing process using the finishing tool on the lens after the roughing process; and a positional deviation detector configured to control the mark position detector and detect a rotational deviation of the lens based on the initial position of the mark and the position of the mark detected by the mark position detector after the roughing process, wherein the controller obtains a roughing path which allows, even if the lens rotates on a chuck center of the lens chuck shafts by an angle as the rotational deviation at the time of the roughing process, and controls the periphery processing tool to perform the finishing process based on the target lens shape which is corrected in view of the angle, wherein the controller obtains an area in a process in which the target lens shape and the initial position of the mark rotate on the chuck center by the angle, and computes the roughing path based on the obtained area, and wherein the controller controls the periphery processing tool to perform the roughing process based on the computed roughing path.

(2) The eyeglass lens processing apparatus according to (1), wherein the marking unit includes a marking tool configured to form the mark on a surface of the lens chucked by the lens chuck shafts, and the marking unit determines the initial position of the mark which is positioned outside the target lens shape, and forms the mark at the determined initial position using the marking tool.

(3) The eyeglass lens processing apparatus according to (1) further comprising a selector including a first mode for processing the lens whose surface is slippery, and a second mode for processing the lens whose surface is normal, wherein the marking unit and the mark position detector are operated if the first mode is selected.

(4) The eyeglass lens processing apparatus according to (1), wherein if the detected rotational deviation exceeds an allowable range, the controller obtains a corrected target lens shape in which the target lens shape is corrected based on the detected rotational deviation, and controls the periphery processing tool to perform the finishing process based on the corrected target lens shape.

(5) The eyeglass lens processing apparatus according to (1), wherein if the detected rotational deviation exceeds an allowable range, the controller obtains a corrected target lens shape in which the target lens shape is corrected based on the detected rotational deviation, obtains a corrected roughing path based on the obtained corrected target lens shape, and controls the periphery processing tool to perform the roughing process based on the corrected roughing path and the finishing process based on the corrected target lens shape.

(6) The eyeglass lens processing apparatus according to (1) further comprising a warning unit configured to give a warning if the detected rotational deviation exceeds an allowable range, the controller stops processing the lens if the detected rotational deviation exceeds the allowable range.

(7) The eyeglass lens processing apparatus according to (2), wherein the marking tool includes at least one of a drilling tool for forming a circle-shaped hole or a slot-shaped hole on the surface of the lens as the mark, and a grindstone or a cutter for forming a line-shaped scratch or groove on the surface of the lens as the mark.

(8) The eyeglass lens processing apparatus according to (1), wherein the mark is a hole or a line-shaped scratch or groove formed on the surface of the lens, and the mark position detector includes a stylus contacting a surface of the lens determined chucked by the lens chuck shafts, and a sensor configured to detect movement of the stylus, wherein the mark position detector locates the stylus at an area of the lens based on the initial position of the mark and detects the position of the mark based on an output signal of the sensor.

(9) The eyeglass lens processing apparatus according to (1), wherein the mark position detector includes an imaging unit for imaging a surface of the lens chucked by the lens chucking shaft and detects the position of the mark by processing an output signal of the imaging unit.

(10) The eyeglass lens processing apparatus according to (1) further comprising a lens chuck unit configured to chuck the lens by the lens chuck shafts, the lens chuck unit including a motor for moving one of the lens chuck shaft toward the other, wherein the lens chuck unit controls pressure for chucking the lens selectively to a first pressure suitable for processing the periphery of the lens and a second pressure lower than the first pressure, wherein the marking unit includes a marking tool for forming a lateral deviation mark on a surface of the lens for detecting a lateral deviation of the lens which occurs when the lens chuck shafts chuck the lens with the first pressure, wherein the marking unit determines an initial position of the lateral deviation mark which is positioned outside the target lens shape and forms the lateral deviation mark at the determined initial position of the lateral deviation mark using the marking tool, wherein the controller drives the motor so that the lens chuck shafts chuck the lens with the second pressure, and thereafter controls the marking unit to form the lateral deviation mark, and thereafter drives the motor so that the lens chuck shafts chuck the lens with the first pressure, and wherein the positional deviation detector controls the mark position detector and detects the lateral deviation of the lens based on the initial position of the lateral deviation mark and the position of the lateral deviation mark detected by the mark position detector after the lens is chucked with the first pressure.

(11) The eyeglass lens processing apparatus according to (10), wherein if the detected lateral deviation exceeds an allowable range, the controller obtains a corrected target lens shape in which the target lens shape is corrected based on the detected lateral deviation, and controls the periphery processing tool to perform the roughing process and the finishing process based on the corrected target lens shape.

(12) The eyeglass lens processing apparatus according to (10) further comprising a warning unit configured to give a warning if the detected lateral deviation exceeds an allowable range, the controller stops processing the lens if the amount of the detected lateral deviation exceeds the allowable range.

(13) An eyeglass lens processing apparatus for processing a periphery of an eyeglass lens, comprising:

a pair of lens chuck shafts configured to chuck the lens;

a lens chuck unit configured to chuck the lens by the lens chuck shafts, the lens chuck unit including a motor for moving one of the lens chuck shaft toward the other;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit including a mark position inputting unit configured to input an initial position of a mark to be formed on the lens for detecting a lateral deviation of the lens which occurs when the lens chuck shafts chuck the lens;

a mark position detector configured to detect a position of the mark formed on the lens;

a controller configured to drive the motor so that the lens chuck shafts chuck the lens and control the periphery processing tool to perform roughing process on the lens using the roughing tool and finishing process on the lens using the finishing tool after the roughing process; and a positional deviation detector configured to control the mark position detector and detect the lateral deviation of the lens based on the initial position of the mark and the position of the mark detected by the mark position detector after the lens is chucked with the first pressure.

(14) The eyeglass lens processing apparatus according to (13), wherein the marking unit includes a marking tool for forming the mark on a surface of the lens, wherein the marking unit determines an initial position of the mark which is positioned outside the target lens shape and forms the mark at the determined initial position using the marking tool, wherein the lens chuck unit controls pressure for chucking the lens selectively to a first pressure suitable for processing the periphery of the lens and a second pressure lower than the first pressure, wherein the controller drives the motor so that the lens chuck shafts chuck the lens with the second pressure, and thereafter controls the marking unit to form the mark, and thereafter drives the motor so that the lens chuck shafts chuck the lens with the first pressure, and wherein the positional deviation detector controls the mark position detector and detects the lateral deviation of the lens based on the initial position of the mark and the position of the mark detected by the mark position detector after the lens is chucked with the first pressure.

(15) The eyeglass lens processing apparatus according to (13), wherein a selector including a first mode for processing the lens whose surface is slippery, and a second mode for processing the lens whose surface is normal, wherein the marking unit and the mark position detector is operated if the first mode is selected.

(16) The eyeglass lens processing apparatus according to (13), wherein if the detected lateral deviation exceeds an allowable range, the controller obtains a corrected target lens shape in which the target lens shape is corrected based on the detected lateral deviation, and controls the periphery processing tool to perform the roughing process and the finishing process based on the corrected target lens shape.

(17) The eyeglass lens processing apparatus according to (13) further comprising a warning unit configured to give a warning if the detected lateral deviation exceeds an allowable range, the controller stops processing the lens if the detected lateral deviation exceeds the allowable range.

(18) An eyeglass lens processing apparatus for processing a periphery of an eyeglass lens, comprising:

a pair of lens chuck shafts configured to chuck the lens;

a lens chuck unit configured to chuck the lens by the lens chuck shafts, the lens chuck unit including a motor for moving one of the lens chuck shaft toward the other, the lens chuck unit controlling pressure for chucking the lens selectively to a first pressure suitable for processing the periphery of the lens and a second pressure lower than the first pressure;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit which includes a marking tool for forming a mark on a surface of the lens for detecting a lateral deviation of the lens which occurs when the lens chuck shafts chuck the lens with the first pressure and a rotational deviation of the lens which occurs at the time of roughing process using the roughing tool, determines an initial position of the mark which is positioned outside the target lens shape, and forms the mark at the determined initial position using the marking tool;

a mark position detector configured to detect a position of the mark formed on the lens;

a controller configured to drive the motor so that the lens chuck shafts chuck the lens and control the periphery processing tool to perform the roughing process on the lens and finishing process on the lens using the finishing tool after the roughing process; and a positional deviation detector configured to control the mark position detector and detect the lateral deviation and the rotational deviation based on the initial position of the mark and the position of the mark detected by the mark position detector after the roughing process, wherein the controller drives the motor so that the lens chuck shafts chuck the lens with the second pressure, and thereafter controls the marking unit to form the mark, and thereafter drives the motor so that the lens chuck shafts chuck the lens with the first pressure, wherein the controller obtains a roughing path which allows, even if the lateral deviation of an amount and the rotational deviation of an angle occur, and controls the periphery processing tool to perform the finishing process based on the target lens shape which is corrected in view of the lateral deviation and the rotational deviation, wherein the controller obtains a first area in a process in which the target lens shape and the initial position of the mark moves in a direction of the lateral deviation by the amount, and obtains a second area in a process in which the obtained first area rotates on a chuck center of lens chuck shafts by the angle, computes the roughing path based on the obtained second area, and wherein the controller controls the periphery processing tool to perform the roughing process based on the computed roughing path.

(19) The eyeglass lens processing apparatus according to (18), wherein if the detected lateral deviation exceeds an allowable range or if the detected rotational deviation exceeds an allowable range, the controller obtains a corrected target lens shape in which the target lens shape is corrected based on the detected lateral deviation or the detected rotational deviation, and controls the periphery processing tool to perform the roughing process and the finishing process based on the corrected target lens shape.

(20) The eyeglass lens processing apparatus according to (18) further comprising a warning unit configured to give a warning if the detected lateral deviation exceeds an allowable range or if the detected rotational deviation exceeds an allowable range, the controller stops processing the lens if the detected lateral deviation exceeds the allowable range or the detected rotational deviation exceeds the allowable range.

DESCRIPTION OF EXEMPLARY EMBODIMENTS

Figure 1:
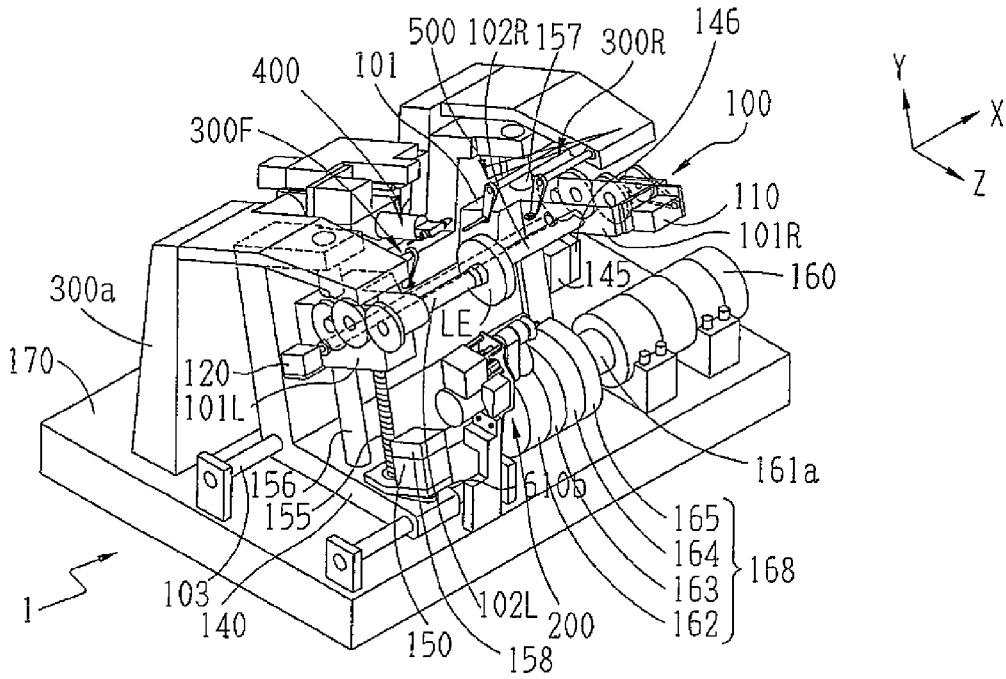
FIG. 1 is a schematic configuration view of an eyeglass lens processing device.

An exemplary embodiment is described based on drawings. FIG. 1 is a schematic configuration view of an eyeglass lens processing device according to the exemplary embodiment.

A carriage portion 100 including a carriage 101 rotatably holding a pair of lens chuck shafts 102L, and 102R is mounted on a base 170 of a processing device 1. A periphery of an eyeglass lens LE held between the chuck shafts 102L and 102R is compressed to and processed by respective grindstones of a grindstone group 168 as a processing tool provided concentrically to a spindle (a rotation shaft of processing tool) 161*a*.

The grindstone group 168 includes a roughing grindstone 162 as a roughing tool, finishing grindstones 163 and 164 as a finishing tool, and a polish-finishing grindstone 165. The finishing grindstones 163 are used for a high curve lens and include a front bevel processing surface for front bevel formation and a rear bevel processing surface for rear bevel formation. The finishing grindstone 164 includes a V groove and a flat-finishing surface for forming a front bevel. The polish-finishing grindstone 165 includes a V groove and a flat-finishing surface for bevel formation. The grindstone spindle 161*a* is rotated by a motor 160. A grindstone rotating unit is configured in this manner. A cutter may be used as the roughing tool and the finishing tool.

The carriage portion 100 includes a chuck unit 110 chucking the lens LE with a predetermined chuck pressure by the chuck shafts 102R and 102L, and a chuck shaft rotating unit 130 rotating the chuck shafts 102R and 102L. The chuck unit 110 includes a motor 111 provided in a right arm 101R of the carriage 101. The chuck shaft 102R is held in the right arm 101 so as to be able to move to the chuck unit 102L. When the motor 111 is driven, the chuck shaft 102R moves to the chuck shaft 102L, and the lens LE is chucked in the chuck shafts 102R and 102L. Since a well known mechanism is used as the chuck unit 110, a detailed description thereof will be omitted.

The chuck shaft rotating unit 130 includes rotation transmitting mechanisms such as a motor 120 provided in a left arm 101L and a gear. The chuck shafts 102R and 102L are rotated in synchronous with the rotation of the motor 120. In the rotation shaft of the motor 120, an encoder 120*a* detecting the rotation angle of the chuck shafts 102R and 102L is provided.

The carriage 101 is mounted on a support base 140 movable along shafts 103 and 104 extended in the X axis direction (the axial direction of the chuck shaft), and linearly moves in the X axis direction due to the rotation of a motor 145. The rotation shaft of the motor 145 is provided with an encoder 146 detecting the movement position of the chuck shaft in the X axis direction. An X axis direction moving unit is configured in this manner. Shafts 156 and 157 extended in the Y axis direction (the direction in which the distance between the chuck shafts 102L and 102R and the grindstone spindle 161*a* is changed) are fixed to the support base 140. The carriage 101 is mounted on the support base 140 so as to be able to move in the Y axis direction along the shafts 156 and 157. A motor 150 for Y axis movement is fixed to the support base 140. The rotation of the motor 150 is transmitted to a ball screw 155 extended in the Y axis direction, and the carriage 101 moves in the Y axis direction due to the rotation of the ball screw 155. An encoder 158 detecting the movement position of the chuck shaft in the Y axis direction is provided in the rotation shaft of the motor 150. A Y axis direction moving unit (a shaft-to-shaft changing unit) is configured in this manner.

Figure 2:
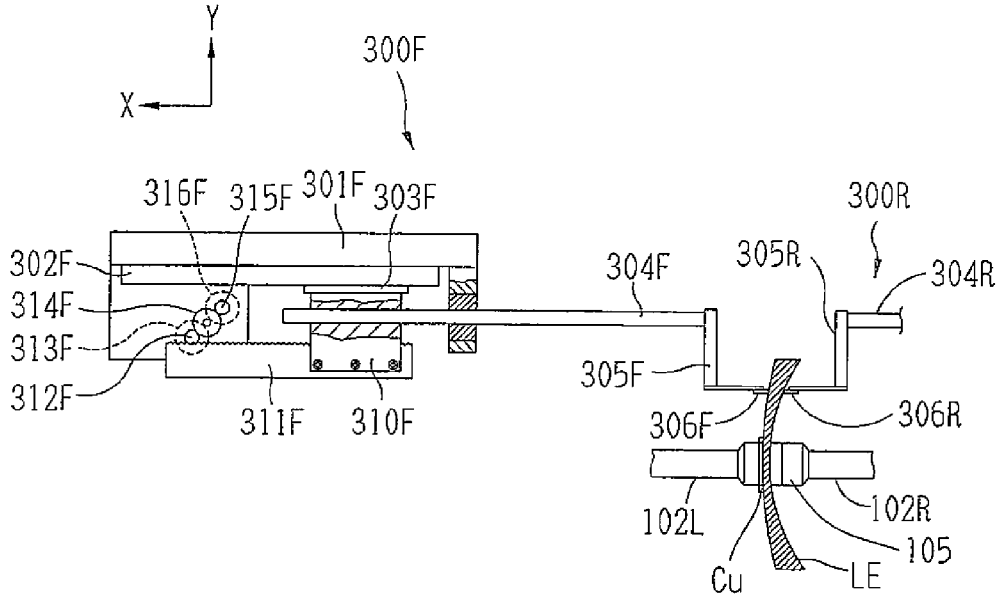
FIG. 2 is a configuration view of a lens edge position detecting unit.

In FIG. 1, lens edge position detecting units (lens shape measuring units) 300F and 300R are provided on the upper left and upper right sides of the carriage 101. FIG. 2 is a schematic configuration view of the detecting unit 300F detecting the position of the front surface of the lens (the edge position of the front surface of lens in the target lens shape).

A support base 301F is fixed to a block 300*a* fixed to a base 170. In the support base 301F, a tracing stylus arm 304F is held to be slidable in the X axis direction, via a slide base 310F. An L shape of a hand 305F is fixed to the end portion of the tracing stylus arm 304F, and a tracing stylus 306F is fixed to the end of the band 305F. The tracing stylus 306F contacts the front surface of the lens LE. A rack 311F is fixed to the bottom part of the slide base 310F. The rack 311F engages with a pinion 312F of an encoder 313F fixed to the support base 301F. The rotation of a motor 316F is transmitted to the rack 311F via the rotation transmitting mechanisms such as gears 315F and 314F, and the slide base 310F moves in the X axis direction accordingly. When the motor 316F is driven, the tracing stylus 306F placed in a retreating position moves to the lens LE, and a tracing pressure is applied to press the tracing stylus 306F on the lens LE. When the front surface position of the lens LE is detected, the chuck shafts 102L and 102R move in the Y axis direction while the lens LE is rotating based on target lens shape data, and the position of the front surface of the lens in the X axis direction (the edge position of the front surface of lens in the target lens shape) is detected by the encoder 313F.

A configuration of the detecting unit 300R for detecting the edge position of the rear surface of lens is bilaterally symmetrical to the detecting unit 300F. Therefore, a description thereof will be omitted by switching "F" with "R" on the end of numerals given to respective components of the detecting unit 300F shown in FIG. 3.

The detecting unit 300F (300R) is also used as a contact type of a mark detecting unit detecting a mark placed on the lens surface (described later) for detecting a positional deviation (rotational deviation and lateral deviation) of the lens.

In FIG. 1, a chamfering unit 200 is disposed in the front side of the device main body. Since the configuration of the chamfering unit 200 is well known, a detailed description thereof will be omitted.

Figure 3:
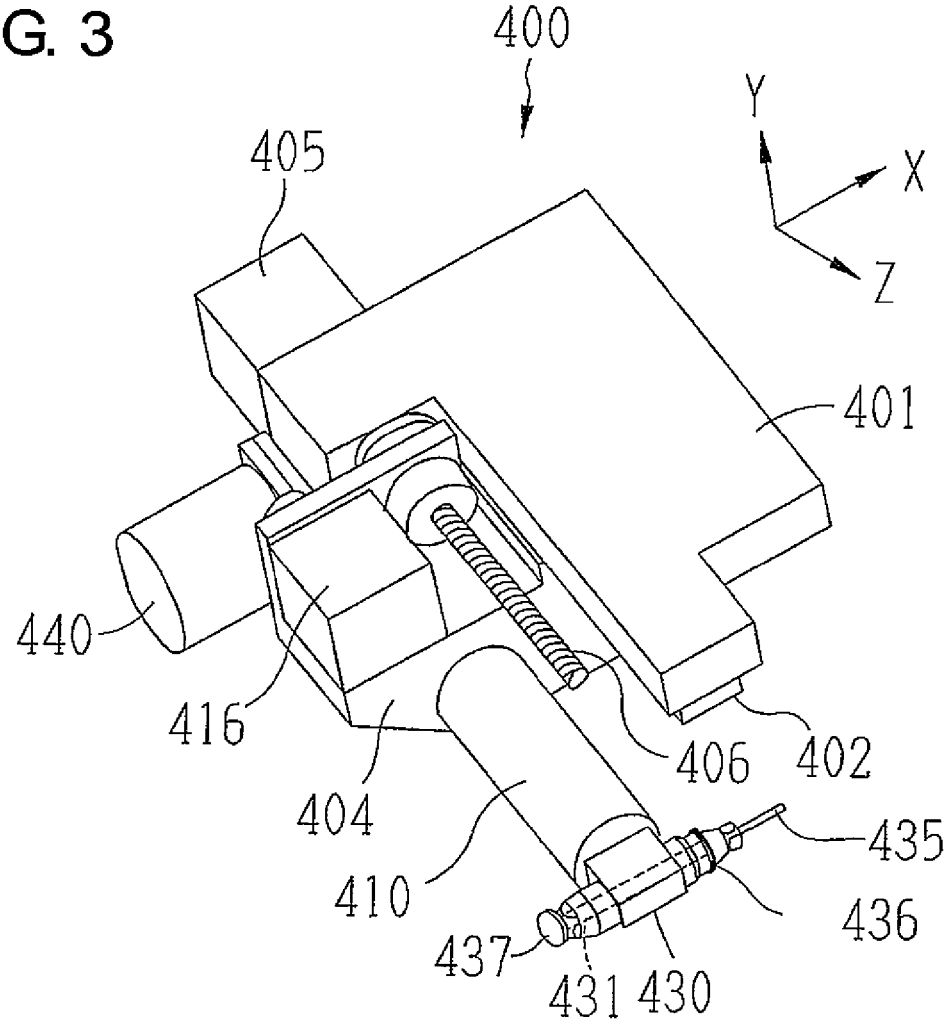
FIG. 3 is a configuration view of a drilling and grooving unit.

A drilling and grooving unit 400 is disposed on the rear of the carriage portion 100, FIG. 3 is a schematic configuration view of the unit 400. A fixing board 401 serving as a base of the unit 400 is fixed to the block 300*a* standing on the base 170 in FIG. 1. A rail 402 extended in the Z axis direction (the direction orthogonal to the XY directions) is fixed to the fixing board 401, a moving support base 404 is slidably provided along the rail 402. The moving support base 404 moves in the Z axis direction when the motor 405 rotates the ball screw 406. The moving support base 404 rotatably holds a rotating support base 410. The rotating support base 410 rotates around its axis due to a motor 416 via the rotation transmitting mechanism.

A rotating portion 430 is provided at an end portion of the rotating support base 410. The rotating portion 430 rotatably holds a rotation shaft 431 orthogonal to an axial direction of the rotating support base 410. At one end of the rotation shaft 431, an endmill 435 as a drilling tool and a cutter (or a grindstone) 436 as a grooving tool are provided concentrically. At the other end of the rotation shaft 431, a step bevel grindstone 437 as a processing tool for correcting a bevel slant or a bevel foot is provided concentrically. The rotation shaft 431 rotates due to a motor 440 provided on the moving support base 404, via the rotation transmitting mechanism disposed inside the rotating portion 430 and the rotating support base 410.

A control of the drilling and grooving performed by the drilling and grooving unit 400 is basically the same as the disclosure of JP-A-2003-145328, hence the description thereof will be omitted.

The drilling and grooving unit 400 is also used as a marking unit forming a mark for detecting the positional deviation (rotational deviation and lateral deviation) of lens on the lens surface or the lens edge. The endmill 435, cutter 436, or grindstone 437 is used as a marking tool.

Figure 4:
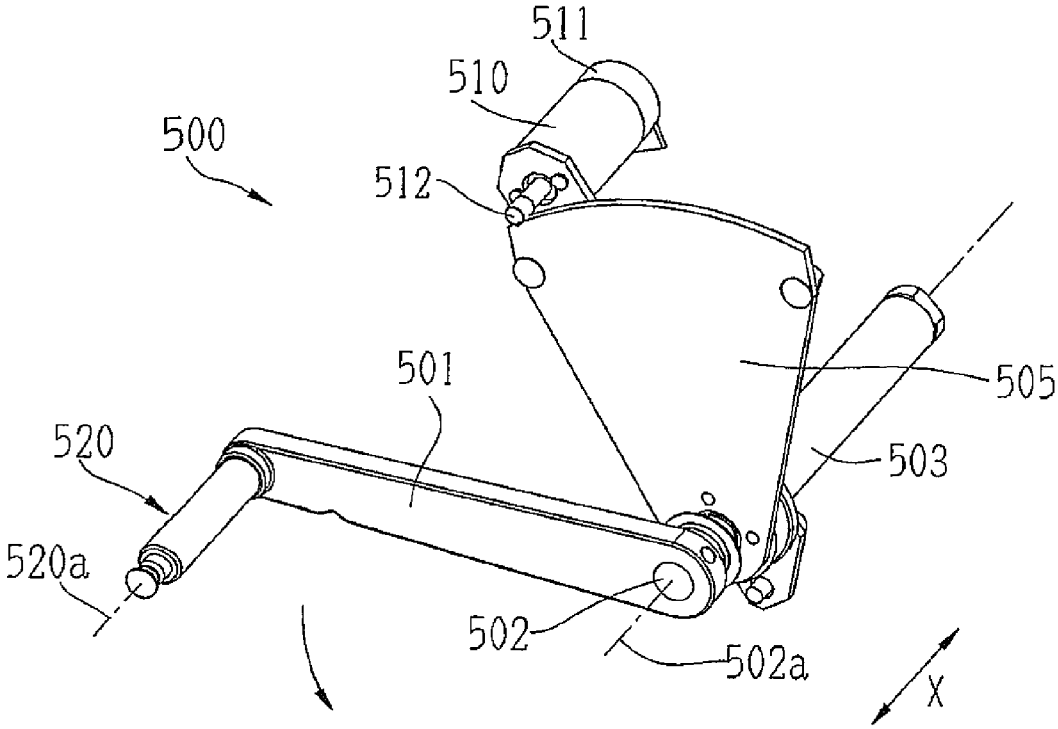
FIG. 4 is a schematic configuration view of a detection unit for the lens external diameter.

In FIG. 1, a lens external diameter detecting unit 500 is disposed on the upper rear of the chuck shaft 102R. FIG. 4 is a schematic configuration view of the lens external diameter detecting unit 500. A cylindrical tracing stylus 520 contacting the edge of lens LE is fixed to one end of an arm 501. A rotation shaft 502 is fixed to the other end of the arm 501. A central axis 520*a* of the tracing stylus 520 and a central axis 502*a* of the rotation shaft 502 are disposed in a positional relation in which the shafts are parallel to the chuck shafts 102L and 102R (X axis direction). The rotation shaft 502 is held in a holding portion 503 so that the rotation shaft 502 can rotate around the central axis 502*a*. The holding portion 503 is fixed to the block 300*a* in FIG. 1. A fan-shaped gear 505 is fixed to the rotation shaft 502 and rotated by a motor 510. A pinion gear 512 engaging with the gear 505 is provided in the rotation shaft of the motor 510. An encoder 511 as a detector is also provided in the rotation shaft of the motor 510.

Figure 5:
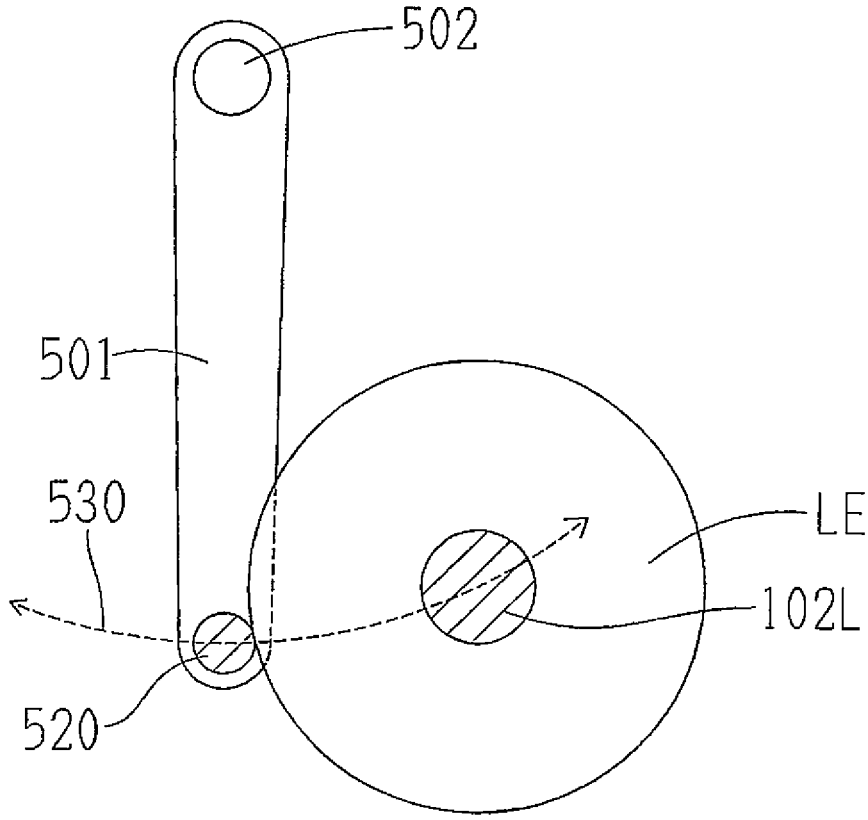
FIG. 5 is a view illustrating the measurement of a lens external diameter performed by a detection unit for the lens external diameter.

When the periphery of normal eyeglass lens LE is processed, the lens external diameter detecting unit 500 is used for detecting whether the external diameter of unprocessed lens LE satisfies the target lens shape. When the external diameter of lens LE is measured, the chuck shafts 102L and 102R move to a predetermined measurement position (on a moving path 530 of the central axis 520*a* of the tracing stylus 520 rotating around the rotation shaft 502) as shown in FIG. 5. The arm 501 is rotated in a direction (Z axis direction) orthogonal to X and Y axes of the device 1 due to the motor 510, the tracing stylus 520 placed in the retreating position moves to the lens LE accordingly, whereby the tracing stylus 520 contacts the edge (periphery) of the lens LE. Also, a predetermined tracing pressure is applied to the tracing stylus 520 due to the motor 510, and when the chuck shafts 102L and 102R rotate once, the lens LE also rotates once accordingly. When the lens LE rotates at each of the predetermined steps with a fine angle, the movement of tracing stylus 520 is detected by the encoder 511, whereby the external diameter of the lens LE having the chuck shaft as a center thereof is measured.

The lens external diameter detecting unit 500 can also be used as a contact type of mark detecting unit detecting a mark formed on the lens edge, to detect the positional deviation (rotational deviation and lateral deviation) of a lens.

Figure 6:
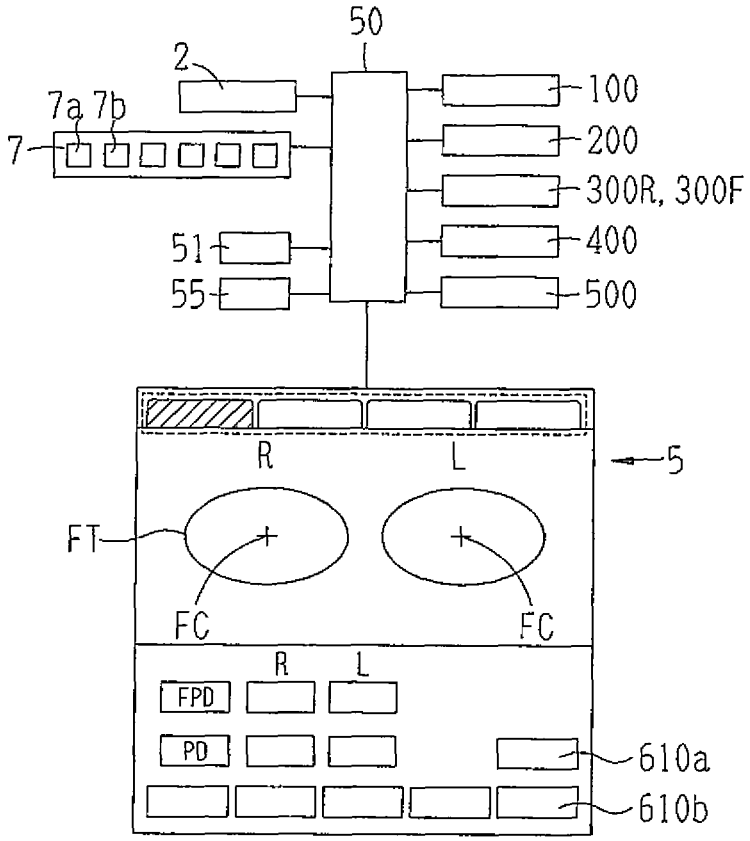
FIG. 6 is a control block diagram of an eyeglass lens processing device.

FIG. 6 is a control block diagram of the eyeglass lens processing device. Each motor of the carriage portion 100, the lens edge position detecting unit 300F and 300R, the chamfering unit 200, the drilling and grooving unit 400, and the lens external diameter detecting unit 500 are connected to a control unit 50. A switch portion 7 and a memory 51 provided with, for example, an eyeglass frame shape measuring device 2, a display 5 functioning as a touch panel for inputting data on the processing condition, and a start switch for processing, are connected to the control unit 50. The display 5 displays a screen for selecting the processing mode. The display 5 displays a layout mode switch 610*a* for selecting either an optical center mode in which the chuck center of the lens LE is set to be the optical center of the lens LE, or a frame center mode in which the chuck center of the lens LE is set to be the geometric center of the target lens shape. The display 5 displays a switch 610*b* for selecting either a water repellent lens mode in which the operation regarding the detection of "positional deviation" is performed when the lens LE has a slippery surface as a water repellent lens, or a normal mode when the lens LE is a normal lens (not a water repellent lens). A switch portion 7 is provided with switches such as a switch 7*a* temporarily chucking the lens LE in the chuck shafts 102L and 102R, and a switch 7*b* starting the processing operation.

Next, an operation of the device will be described focusing mainly on the action against the "positional deviation" of lens LE. First, the operation regarding the action against the "rotational deviation" is described. To simplify the description, the "rotational deviation" is described on the assumption that "lateral deviation" does not occur.

When a predetermined switch displayed on the display 5 is pressed, the target lens shape data obtained by the eyeglass frame shape measuring device 2 is input to the memory 51. The setup screen of the display 5 displays a figure FT based on the target lens shape. The layout data such as the pupil distance (PD value) of an eyeglass wearer, the frame pupillary distance (FPD value) between the left and right lens of an eyeglasses, and the optical center of lens to the geometric center FC of the target lens shape are input by a predetermined switch provided on the setup screen of the display 5. When the lens LE is a water repellent lens, a "water repellent lens" mode is set by the switch 610*a*. For the chuck center of the lens LE, the frame center mode is selected by the switch 610*b*.

As a preparation before processing the lens LE, an operator blocks (attach) the front surface of the lens LE to a cup Cu using an adhesive tape, by means of a well known blocking device (refer to JP-A-2007-275998 (US 200722691 A1), for example). When the start switch 7*b* is pressed after the lens LE is chucked in the chuck shafts 102L and 102R, the control unit 50 first drives the lens external diameter detecting unit 500 and then checks whether the diameter of an unprocessed lens is insufficient or not with respect to the target lens shape. Next, the control unit 50 drives the lens position detecting unit 300F and 300R based on the target lens shape data, thereby obtaining the edge position data of the front and rear surfaces of a lens. When the "water repellent lens" mode is set, as an action against the "rotational deviation" of the lens LE due to the roughing process, the control unit 50 determines the formation position of the mark M1 based on the target lens shape data, so as to form the mark M1 on the lens surface for detecting the "rotational deviation" and to scrape off the mark M1 after the final finishing process.

Figure 7:
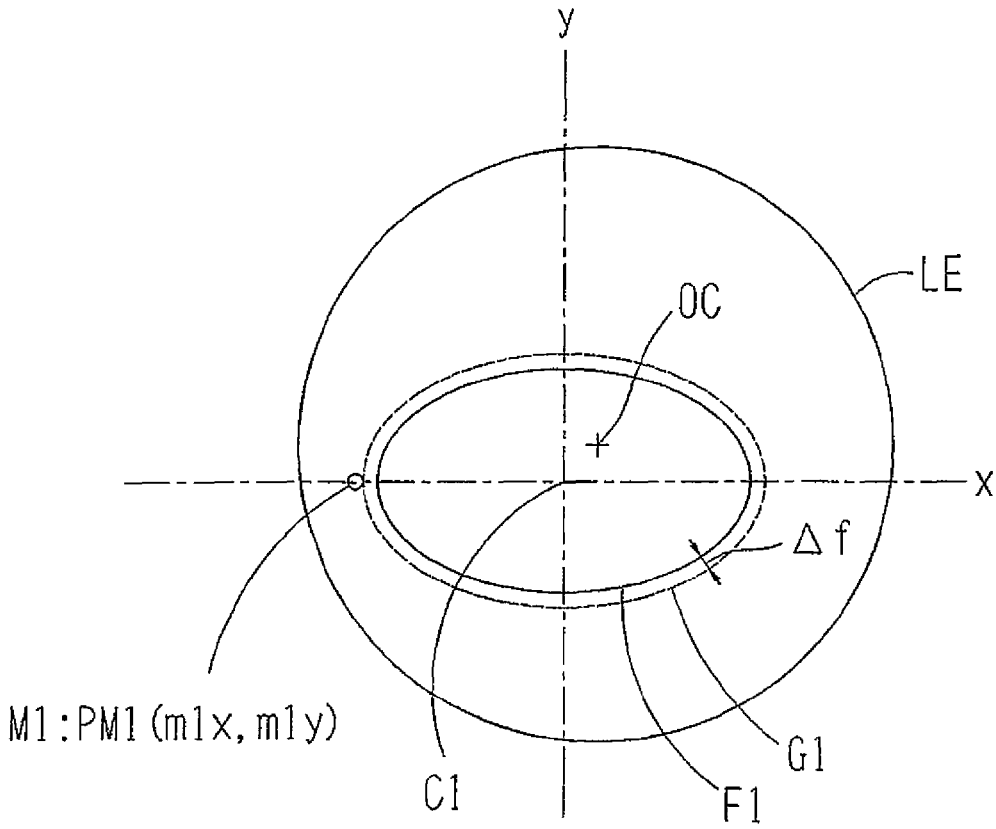
FIG. 7 is a view illustrating a setting example of a mark for detecting rotational deviation.

FIG. 7 is a view showing a setting example of the position of the mark M1. In the example in FIG. 7, the mark M1 has a hole shape formed by the endmill 435 of the drilling and grooving unit 400. Although the hole may be a through hole, the hole herein is made into a counterbore hole having a certain depth from the lens surface to shorten processing time. The hole size is about 0.8 mm to 2 mm. In FIG. 7, F1 is a finishing path, and this path corresponds to the target lens shape. C1 is the chuck center (the rotation center of lens) and becomes the geometric center of the target lens shape in the frame center mode. OC is the optical center of the lens LE. G1 shows the roughing path obtained by increasing the size of the finishing path F1 by a predetermined finishing lens margin Δf (for example, 2 mm). A position PM1 (m1*x*, m1*y*) of the mark M1 is set outside the finishing path F1 (more preferably, outside the roughing path G1) such that the mark M1 is scraped off after finishing process. In order to reduce the lens margin as much as possible after correcting the "rotational deviation", it is preferable for the position PM1 to be set near the path F1 (for example, within 5 mm from the path F1). In order to improve detection accuracy of the "rotational deviation", it is preferable for the mark M1 to be positioned as far as possible from the chuck center C1. In the example of FIG. 7, the mark M1 is set near the path F1 in the direction in which the length of radius vector of the path F1 from the chuck center C1 is the longest. When the distance between the center C1 and the mark M1 is too far, the rotational deviation tends to occur even during the processing after correction of the rotational deviation. Therefore, in the relation with the detection accuracy of the rotational deviation, a certain limit that, for example, the position of the mark M1 is set within a predetermined distance from the chuck center C1 (25 mm for example) may be provided. The position M1 (m1*x*, m1*y*) of the mark M1 is set as a data based on the chuck center C1, and stored in the memory 51 as initial position (formation position) data of the mark M1 (input automatically by the control unit 50).

Prior to drilling, the control unit 50 drives the lens position detecting unit 300F based on the position PM1 of the mark M1, thereby obtaining the position data of the lens surface on which the mark M1 is positioned (X direction of the device 1). Subsequently, the control unit 50 drives the drilling and grooving unit 400 as a marking unit and performs drilling on the lens surface based on the position data of the mark M1. The control unit 50 drives the motor 405 so as to move the rotating portion 430 toward the processing position, and also drives the motor 440 to position the endmill 435 in parallel with the X direction (chuck shaft). Next, the control unit 50 controls the Y and X directions of the chuck shafts 102L and 102R according to the position data of the mark M1, and controls the rotation of chuck shafts 102L and 102R to move the lens LE to the endmill 435, thereby processing the hole of the mark M1 on the lens surface. In this example, the hole direction of the mark M1 is in a direction parallel to the chuck shaft.

After the formation of the mark M1, the processing proceeds to the roughing process performed by the roughing grindstone 162. The control unit 50 performs the roughing process on the periphery of the lens LE based on roughing path of a first step described later, by means of the roughing grindstone 162. The roughing path of a first step is set (computed) by the control unit 50, as a path enabling correction even after the "rotational deviation" occurs during the roughing process. The control unit 50 also serves as a computing unit.

Figure 8:
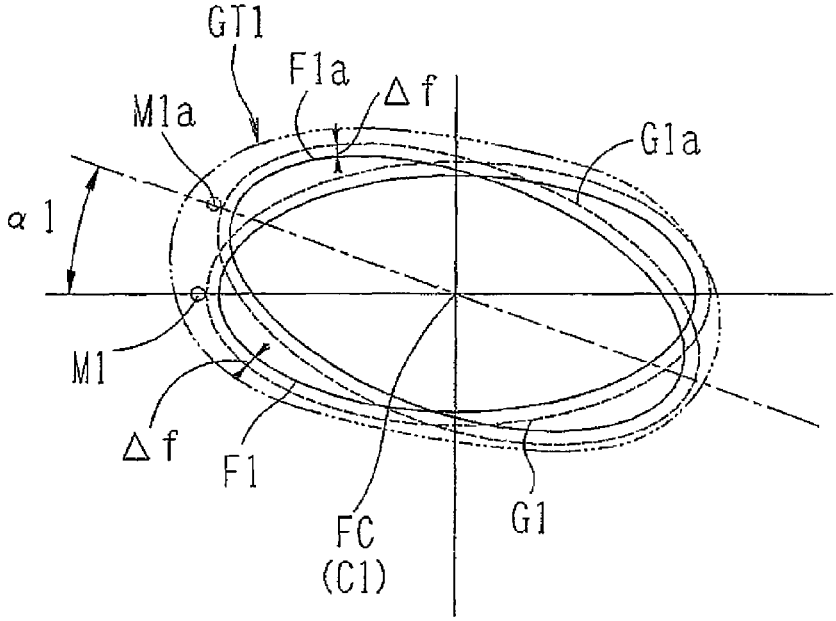
FIG. 8 is a view illustrating a roughing path of a first step.

FIG. 8 is a view illustrating the setting (computing) of the roughing path of a first step. In FIG. 8, F1 is the target lens shape (finishing path) in a case where the "rotational deviation" does not occur. Based on the chuck center C1 as the center, an angle in a case where the "rotational deviation" occurs during roughing process is regarded as an angle $\alpha 1$. The angle $\alpha 1$ is an allowable angle for enabling correction even after the "rotational deviation" occurs. For instance, the angle $\alpha 1$ is 15°, and it is an angle set to cover almost the angle of "rotational deviation" occurring during processing of a normal lens. The direction in which the "rotational deviation" occurs is determined in relation to the rotation direction of the roughing grindstone 162.

The path G1 is obtained by adding a predetermined finishing lens margin $\Delta f$ to the finishing path F1 in a case where the "rotational deviation" does not occur. F1*a* is the target lens shape formed when the path F1 rotates on the chuck center C1 by the angle $\alpha 1$. G1*a* is a path obtained by adding a predetermined finishing lens margin $\Delta f$ to the target lens shape F1*a*. A roughing path GT1 includes the area (the outermost path) in the process in which the path F1 of the target lens shape rotates on the chuck center C1 by the angle $\alpha 1$ set on the assumption that the "rotational deviation" occurs, and is found so as to include at least the area obtained by adding the finishing lens margin $\Delta f$ to the above area. Even when the "rotational deviation" of the angle $\alpha 1$ occurs, it is necessary for the mark M1 to remain after roughing process. M1*a* is a position of the mark M1 obtained when M1 rotates by the angle $\alpha 1$. Accordingly, when the mark M1 is outside the finishing path F1, the roughing path GT1 is found to include the area in the process in which the mark M1 rotates on the chuck center C1 from the position PM1 to the position M1*a*. When the periphery of the lens LE is processed by the roughing grindstone 162, it is difficult to process a shape to be more depressed than the radius of the roughing grindstone 162. Therefore, as a combined path of the path G1 and the path G1*a*, a final roughing path GT1 is found as the two-dot chain line shown in FIG. 8 to enable processing in the external diameter of the roughing grindstone 162. When the roughing process is performed on the lens LE according to the roughing path GT1, if the "rotational deviation" occurring during the roughing process is within the angle $\alpha 1$, correction can be performed thereafter. It is preferable that the roughing path GT1 is so found that the remaining lens margin is reduced as much as possible. The smaller the remaining lens margin, the lower the possibility that the "rotational deviation" will reoccur during correction of the "rotational deviation".

The control unit 50 obtains the roughing data, the movement data of the chuck shafts 102L and 102R per rotation angle based on the roughing path GT1 found in the above manner, positions the lens LE on the roughing grindstone 162, controls the motors 150 and 120 according to the roughing data, and performs the roughing process on the periphery of the lens LE.

When a first step of roughing process ends, the processing proceeds to detection of the mark M1. The operation of position detection of the mark M1 will be described using FIG. 9. The control unit 50 drives the lens position detecting unit 300F as a mark detecting unit and detects the hole position of the mark M1 by bringing the tracing stylus 306F into contact with the lens surface. Based on the distance between the chuck center C1 and the initial position PM1 of the mark M1, the tracing stylus 306F is brought into contact with the initial position PM1 at a slight distance ahead, and the lens LE so rotates that the tracing stylus 306F relatively moves in the direction where the "rotational deviation" occurs. When the tracing stylus 306F contacts the hole of the mark M1, the profile data of the signal output from the encoder 313F is changed drastically. From the rotation angle of the lens LE at this time, a position PM1*b* (m1*bx*, m1*by*) of the mark M1 is detected. Through the comparison of the detection result to the initial position PM1 of the mark M1, an angle $\Delta\alpha$ of the "rotational deviation" is detected. Searching for the mark M1 is performed by the detecting unit 300F in a range (angle $\alpha 1$) where the "rotational deviation" is assumed, and when the mark M1 is not detected in the range, it is determined that the "rotational deviation" is larger than the assumed angle.

When the angle $\Delta\alpha$ is in a predetermined allowable range, it is determined that an action against the "rotational deviation" is not necessary. When the "rotational deviation" does not occur, the roughing process is performed on the remaining portion based on the path G1 of the initial target lens shape data, and subsequently the finishing process is performed by the finishing grindstone 164 based on the finishing path F1. When a flat-processing mode is set in the finishing process, the periphery of the lens LE finished with the roughing process is processed by the flat-processing surface of the finishing grindstone 164. When a bevel processing mode is set, the periphery of the lens LE finished with the roughing process is processed by the V groove on the finishing grindstone 164. Since the finishing process is barely related to the exemplary embodiment and well known techniques can be used for it, the description thereof will be omitted. In this manner, an operator does not need to check the "rotational deviation", and when the "rotational deviation" does not occur, the periphery of lens LE is then automatically processed, based on the input target lens shape; accordingly, the efficiency can be achieved in the processing.

Next, an action against a case where the angle Δα of the "rotational deviation" exceeds the allowable range will be described. As the action against the "rotational deviation", there are a re-blocking method (a method of reattaching the cup Cu on the lens surface), and an automatic correction in which the "rotational deviation" is automatically corrected based on the angle Δα for processing. Which one is performed may be selected by a mode selecting switch (not shown) displayed on the display 5.

The operation in the case of re-blocking will now be described. When it is determined that there is "rotational deviation", the processing operation thereafter is stopped, and a warning providing notification of the occurrence of "rotational deviation" is displayed on the display 5. The display 5 may also display the angle Δα of the "rotational deviation". In this manner, an operator can understand the degree of "rotational deviation". When the same type of lens as a lens in which the "rotational deviation" occurs is processed again, by using a technique disclosed in, for example, JP-A-2009-136969 (US 2009176442 A1), the necessity for mode setting to prevent the "rotational deviation" and for parameter change can be easily understood.

After taking the lens LE out of the chuck shafts 102L and 102R, the operator again attaches the cup Cu on the lens surface in a predetermined procedure the same as the case of an unprocessed lens (a procedure which makes the optical center of lens and the astigmatic axis have a predetermined relation with the cup Cu). In this manner, the "rotational deviation" is corrected. After the lens LE is chucked in the chuck shafts 102L and 102R, when the process start switch is pressed, the edge position detection of lens surface, roughing process, and finishing process are performed by the lens position detecting units 300F and 300R, just like the normal processing steps. In this way, even when the "rotational deviation" occurs, the correction can be performed by reattaching the cup Cu, and thus it is possible to inhibit the occurrence of an unusable lens. During the re-blocking, the normal processing step may also be performed by selecting the normal mode with the switch 7*b*.

Figure 9:
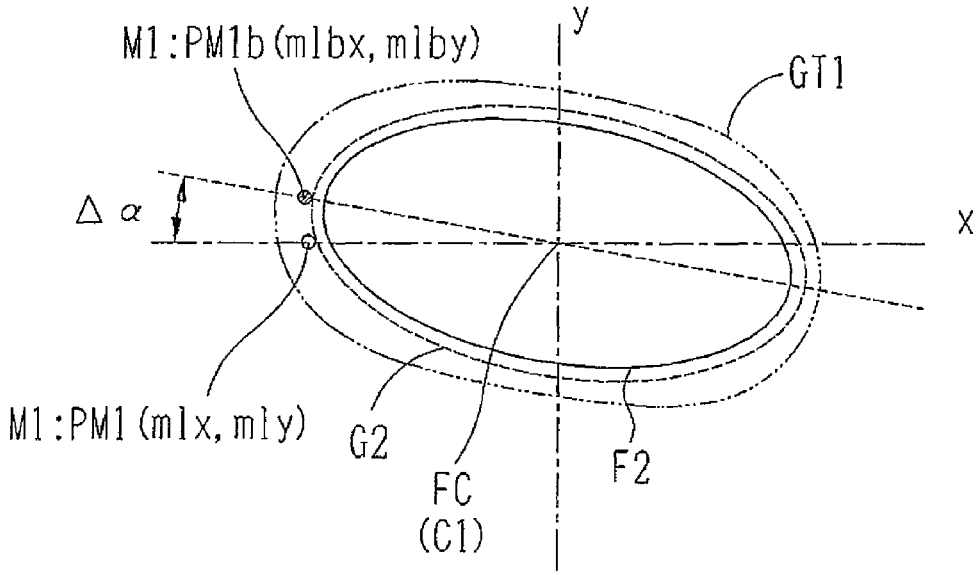
FIG. 9 is a view illustrating an example of mark detection.

The operation of automatic correction will now be described. When it is determined that there is "rotational deviation" from the detection result of the mark M1, the control unit 50 corrects the finishing path and the roughing path based on the angle Δα. That is, with respect to the finishing path F1 shown in FIGS. 7 and 8, by rotating the path F1 (target lens shape data) on the chuck center C1 by the angle Δα, a finishing path F2 after the correction is found as shown in FIG. 9. The path F2 is recalculated as the data based on the chuck center C1. A roughing path G2 after correction is found by adding the finishing lens margin Δf to the path F2. When the operation for the correction path ends, the lens position detecting units 300F and 300R operate based on the path F2, whereby the edge position of the front and rear surface of lens in the target lens shape (path F2) is detected. The detection result of the edge position of the front and rear surface of lens is used for determining the bevel apex position during the bevel processing, and for determining the chamfering position during the chamfering. Thereafter, a second step of roughing process is performed by the roughing grindstone 162 based on the path G2, and the finishing process is performed by the finishing grindstone 164 based on the path F2. In a second step of roughing process and finishing process, since most of the portion departing from the chuck center C1 is scraped off by a first step of roughing process, the occurrence of "rotational deviation" is reduced. In this automatic correction, there is no process in which an operator takes the lens LE out of the device or reattaches the cup Cu; therefore, when the "rotational deviation" occurs, lens processing can be more efficiently performed.

In any of the automatic correction and re-blocking, the lens margin after a first step of roughing process is small, therefore, it is possible to omit the roughing step and proceed to the finishing process performed by the finishing grindstone 164. In the processing after a first step of roughing process, it is possible to automatically proceed to a processing mode where the processing load to the lens LE is further suppressed, by using the technique disclosed in, for example, JP-A-2006-334701 and JP-A-2009-136969.

In the example of the device, it is also possible to use the lens external diameter detecting unit 500 as a detecting unit of the mark M1. In this case, the mark M1 is formed as a through hole, and it is set so that the roughing path GT1 in the FIG. 8 passes through the center of the mark M1. On the edge of lens LE after the roughing process based on the roughing path GT1, the mark M1 remains as a notch. When external diameter detection is performed while the tracing stylus 520 is contacting the edge of lens LE after the roughing process, the notch, the mark M1, is detected.

The shape of the mark M1 is not limited to a circle, and it may be a slotted-shaped hole. In detection of the "rotational deviation", it is advantageous to know the rotation angle of the lens LE. Therefore, when the shape is made into the slotted-shaped hole in a direction passing through the chuck center C1, the detection of the mark performed by the detecting unit 300F becomes easy. In formation of the mark M1, it is also possible to use the cutter 436 for grooving or the grindstone 437 for bevel correction. In the processing using the cutter 436 or the grindstone 437, since the line-shaped (scratch-shaped or groove-shaped) mark M1 is formed on the lens surface, the mark M1 may be formed so that M1 is in a direction passing through the chuck center C1, as described above.

Figure 10:
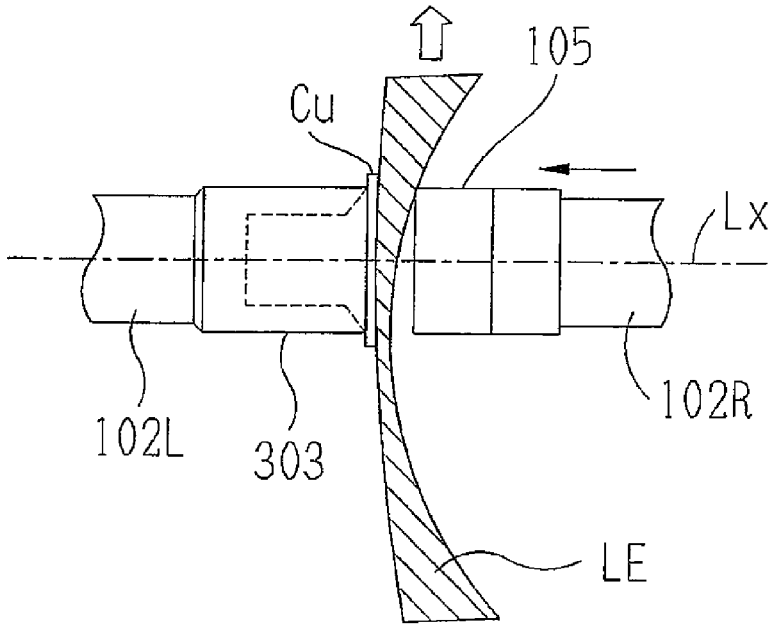
FIG. 10 is a view illustrating the occurrence of "lateral deviation".

Now, the "lateral deviation" will be described. The "lateral deviation" mainly occurs when the chuck center is not positioned on the optical center of lens. For instance, as shown in FIG. 10, when the lens LE is a concave lens and the chuck center is a frame core chuck, the chuck shaft 102R moves to the lens LE, and a lens pressing member 105 provided at the end of chuck shaft 102R contacts the rear surface of lens LE. At this time, the lens pressing member 105 does not evenly touch the curve of the rear surface of the lens, lopsided pressure is applied to the rear surface of the lens. When the surface of lens LE is slippery and the chuck pressure is strong, the lens LE under the chuck pressure slides in the direction orthogonal to the chuck shaft direction. The "lateral deviation" in the specification refers to a state where the chuck position of lens deviates in the direction orthogonal to the axial direction of the chuck shafts 102L and 102R, with respect to the chuck center of chuck shafts 102L and 102R.

Hereinbelow, regarding the operation in regard to the action against the "lateral deviation", a case where the frame center mode is selected will be described. Since the preparation before processing is the same as above, the description thereof will be omitted. The action against "lateral deviation" is performed when the water repellent mode is set.

When the chuck instruction signal is input by the switch 7*a*, the motor 111 is driven by the control unit 50, the lens LE is temporarily chucked by the chuck shafts 102L and 102R. Subsequently, when the start signal is input by the start switch 7*b*, the motor 111 is further driven, and the lens LE is subjected to the actual chucking with a predetermined chuck pressure set to be suitable for periphery processing of the lens LE. The chuck pressure in the actual chucking is, for example, 45 kg, and the chuck pressure in the temporary chucking is weaker than that in the actual chucking, for example, 25 kg. The chuck pressure in the temporary chucking is set to such a strength that, when an operator carries the lens LE and chucks it in the chuck shafts 102L and 102R by hand, even if the operator's finger is accidentally caught between the lens LE and the lens pressing member 105 at the end of chuck shaft 102R, the finger is not injured. In the temporary chucking in which such strength is set, the "lateral deviation" of lens LE does not occur. The "lateral deviation" mainly occurs during actual chucking in which large chuck pressure is applied. Accordingly, in the configuration of forming the mark for detecting "lateral deviation" by the marking unit of the device 1, the mark is formed after the temporary chucking and before the actual chucking.

Figure 11:
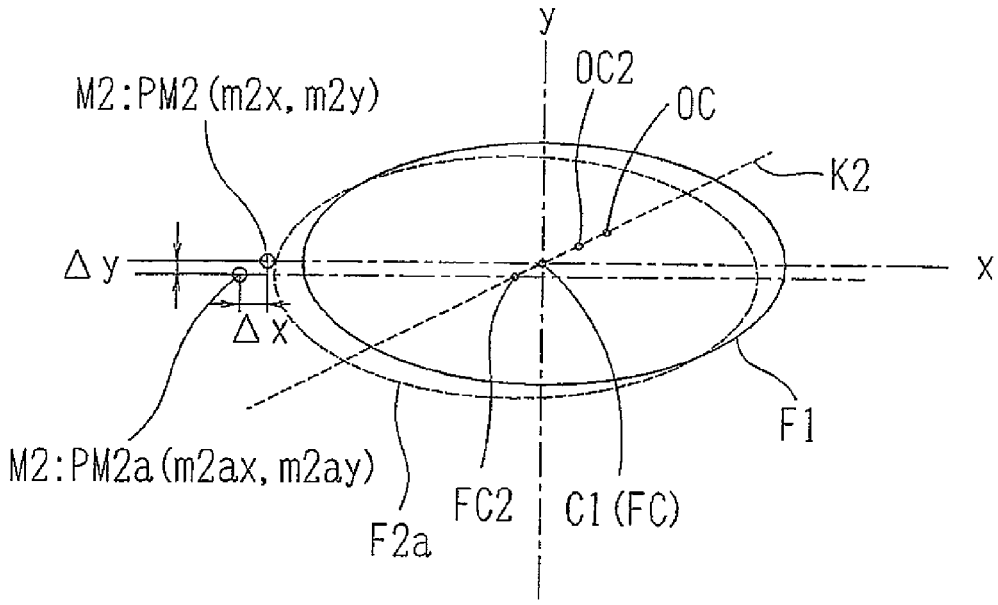
FIG. 11 is a view illustrating a setting example and detection of a mark for detecting lateral deviation.

The setting of the mark formation position will be described. When only the "lateral deviation" is detected, since the mark is scraped off after the final finishing process, the formation position of the mark can be placed anywhere as long as the position is outside the target lens shape (finishing path) F1 shown in FIG. 7. For instance, as shown in FIG. 11, a position PM2 (m2*x*, m2*y*) of a mark M2 is set outside the finishing path F1 (preferably, outside the roughing path) and near the path F1. More preferably, the initial position of the mark M2 is found at the same position as the position PM1 in FIG. 7 so that the M2 is used in combination with the mark M1 for detecting "rotational deviation". The position PM2 (m2*x*, m2*y*) is the data obtained based on the chuck center C1.

The control unit 50 operates the chuck unit 110 to chuck the lens LE with the chuck pressure set for temporary chucking, and then operates the drilling and grooving unit 400 to form a hole as the mark M2 (the same hole as the mark M1) on the lens surface by the endmill 435, as described above. When a signal is input from the start switch 7*b*, the control unit 50 chucks the lens LE with the chuck pressure for actual chucking, and then operates the lens position detecting unit 300F to detect the mark.

The mark detecting operation will now be described. The "lateral deviation" results from the different positional relation between the chuck center C1 and the optical center OC of lens LE, and when the lens LE is a concave lens, "lateral deviation" occurs mainly in a direction where the optical center OC approaches the chuck center C1. The positional relation (K2 direction) between the chuck center C1 and the optical center OC can be known by the input of the layout data such as the PD value, FPD value, and the height of the optical center. By moving the lens LE (chuck shafts 102L and 102R), the control unit 50 relatively positions the tracing stylus 306F at the initial position PM2 of the mark M2, thereby checking whether the mark M2 is present. When there is no mark M2, the control unit 50 moves the tracing stylus 306F from the vicinity of the position PM2 to the range set on the assumption that the "lateral deviation" occurs mainly in the K2 direction, thereby searching for the movement position of the mark M2. A position PM2*a* (m2*ax*, m2*ay*) in the FIG. 11 is a position to which the mark M2 moves by the "lateral deviation". The position PM2*a* is detected by the profile data of signal output from the encoder 313F. Through the comparison of the initial position PM2 to the position PM2*a*, the data (Δx, Δy) of the "lateral deviation" is detected.

In detecting the "lateral deviation", it is also possible to form a notch as the mark M2 on the edge of an unprocessed lens and use the lens external diameter detecting unit 500 as a mark detecting unit. For instance, after the temporary chucking, the edge position of lens LE is obtained by measuring the external diameter of the edge of unprocessed lens LE by the detecting unit 500, and then a notch detectable by the tracing stylus 520 is formed as the mark M2 by the endmill 435 or the like. The formation position of the notch is stored (input) in the memory 51, as the initial position of the mark M2. After the actual chucking, the detecting unit 500 is driven again to measure the edge of lens LE, whereby the position of the mark M2 formed to be a notch is detected.

The operation following the detection of "lateral deviation" will now be described. When the detection data (Δx, Δy) of the "lateral deviation" is within the allowable range, it is determined that the action against the "lateral deviation" is not necessary, and the normal processing operation is performed (when the "rotational deviation" is taken into consideration, the operation for detecting and counteracting "rotational deviation" as described above is included).

When the detection data (Δx, Δy) exceeds the allowable range, a re-blocking method (a method of reattaching the cup Cu on the lens surface), and an automatic correction in which the "lateral deviation" is automatically corrected based on the detection data (Δx, Δy) for processing, similarly to the case of "rotational deviation" can be employed.

The operation in the case of re-blocking will now be described. When it is determined that there is "lateral deviation", the processing operation thereafter is stopped, and a warning providing notification of the occurrence of "lateral deviation" is displayed on the display 5. An operator takes the lens LE out of the chuck shafts 102L and 102R, and reattaches the cup Cu on the surface of lens LE by using a blocking device (a blocker). At this time, it is possible to inhibit the occurrence of the "lateral deviation" in chucking by the following methods. The first one is the method in which an adhesive tape made of a polyester film or the like is attached on the lens surface, and the cup Cu is attached thereon with a double-sided tape. Since the surface of film does not slide easily, the "positional deviation" including the "lateral deviation" decreases. The second one is the method in which the cup Cu is attached on the optical center of lens, and the layout mode is changed from the "frame center mode" to the "optical center mode". If the cup Cu is attached on the optical center of lens, the "lateral deviation" is basically resolved. Accordingly, when the "optical center mode" is selected, the operation for forming and detecting the mark M2 for detecting the "lateral deviation" may be omitted.

The operation of automatic correction will be described. When it is determined that there is "lateral deviation", as shown in FIG. 11, a path F2*a* in which the path F1 having a target lens shape has been corrected by the control unit 50 is found based on the detection data (Δx, Δy) of the "lateral deviation". The path F2*a* is a path obtained by the parallel translation of the path F1 from the chuck center C1 by the detection data (Δx, Δy), and the radius vector data thereof from the chuck center C1 is recalculated. The input geometric center FC and the optical center OC of the target lens shape are also recalculated as a position FC2 and OC2 resulting from the parallel translation by the detection data (Δx, Δy). When the action is necessary only for the "lateral deviation", the subsequent operation for detecting the edge position of lens surface performed by the lens position detecting units 300F and 300R, the roughing process, and the finishing process are performed based on the path F2*a* (target lens shape) after correction. In this manner, lens processing in which the "lateral deviation" occurs is efficiently performed without burdening the operator.

When the action against the "rotational deviation" is set, the operation for counteracting the "rotational deviation" is performed as described above. In the operation to which the action against the "rotational deviation" is added, when the mark M2 is formed under the same condition as the mark M1 shown in FIG. 7, it is possible to use the mark M2 as the mark M1 and omit the formation process of the mark M1, whereby the overall processing time can be shortened.

It is possible to simultaneously perform the formation and detection process of the mark for the "lateral deviation" detection and the "rotational deviation" detection. Hereinbelow, based on FIG. 12, a case where the "lateral deviation" detection and the "rotational deviation" detection are simultaneously performed will be described.

Figure 12:
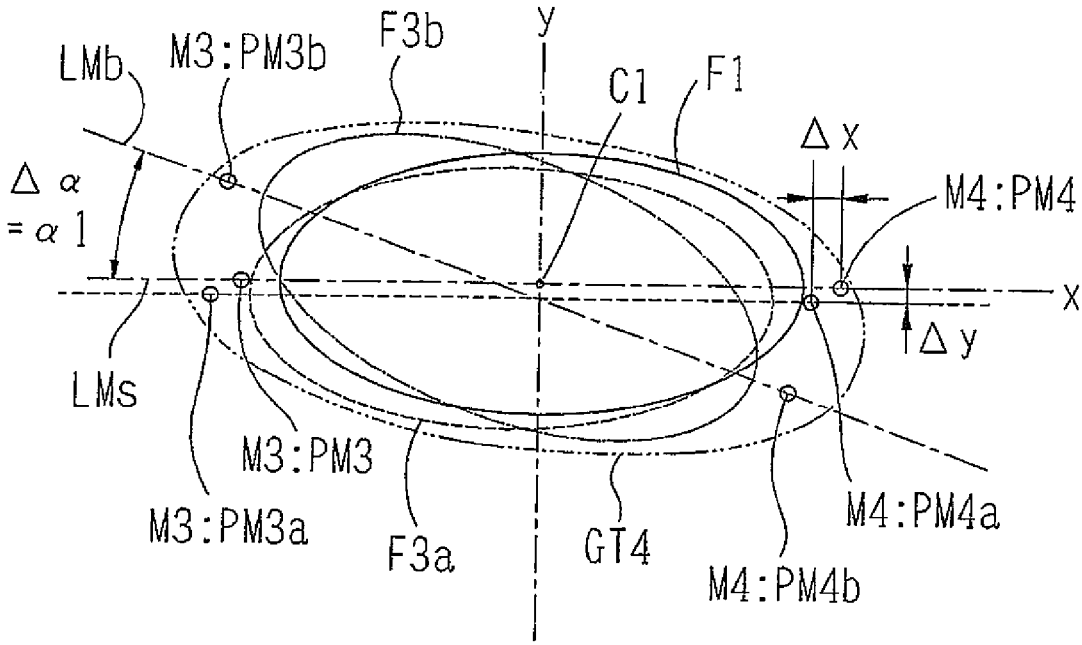
FIG. 12 is a view illustrating a setting example and detection of a mark for detecting lateral deviation and rotational deviation.

In FIG. 12, the initial positions of the two marks M3 and M4 are found to be positioned outside the input path F1 of the target lens shape. For instance, an initial position PM3 of the mark M3 and an initial position PM4 of the mark M4 are set on the x axis passing through the chuck center C1. The positions PM3 and PM4 of the marks M3 and M4 are set to satisfy the condition for "rotational deviation" detection. That is, the PM3 and PM4 are set outside the path F1 having a target lens shape and near the path F1, or, set to be positioned within a certain distance from the chuck center C1.

Next, it is supposed that the "lateral deviation" occurs due to the actual chucking of lens LE, and the positions of the marks M3 and M4 move to the positions PM3*a* and PM4*a* respectively. Further, it is supposed that the "rotational deviation" occurs due to the roughing process on lens LE, and the positions of the marks M3 and M4 move to the positions PM3*b* and PM4*b*. A line passing through the initial position PM3 of the mark M3 and the initial position PM4 of the mark M4 is denoted as LMs. A line passing through the position PM3*b* of the mark M3 and the position PM4*b* of the mark M4, the positions after the occurrence of "rotational deviation", is denoted as LMb. The angle $\Delta\alpha$ between the lines LMs and LMb is found as the "rotational deviation" angle. By rotating the positions PM3*b* and PM4*b* on the chuck center C1 by the angle $\Delta\alpha$ in the reverse direction with respect to the direction where the "rotational deviation" occurs, the positions PM3*a* and PM4*a* of the mark M3, the positions before the occurrence of "rotational deviation", are found. Through the comparison of the initial position PM3 to the position PM3*a* of the mark M3 (or the comparison of the initial position PM4 to the position PM4*a* of the mark M4), the detection data ($\Delta x$, $\Delta y$) of "lateral deviation" is found.

In the actual operation of device, the chuck instructing signal is input by the switch 7*a*, the lens LE is temporarily chucked by the chuck shafts 102L and 102R, and then the drilling and grooving unit 400 is driven, whereby the marks M3 and M4 are respectively formed at the positions PM3 and PM4 as shown in FIG. 12. When a signal is input from the start switch 7*b*, the lens LE is chucked with the chuck pressure for actual chucking, followed by a first step of roughing process. In the first step of the roughing process, a roughing path GT4 is found so that, even when the "rotational deviation" occurs in addition to the "lateral deviation", the correction thereafter becomes possible and the marks M3 and M4 remain. That is, first, when a predetermined lateral deviation amount set to enable the correction of "lateral deviation" occurs, a first area including a process in which the path F1 having a target lens shape and marks M3 and M4 are moved by the lateral deviation amount set on the assumption that the "lateral deviation" occurs is found. Next, assuming that the "rotational deviation" is added thereto, when the rotation occurs by a predetermined angle $\alpha$1 set to enable the correction of "rotational deviation", a second area including a process in which a first area is rotated by the angle $\alpha$1 set on the assumption that the "rotational deviation" occurs is found, so that the process in which the path F1 and the marks M3 and M4 are moved is included therein. The roughing path GT4 is found so as to include a range obtained by adding a predetermined finishing lens margin $\Delta f$ to a second area. In calculating the roughing path GT4, in consideration of the diameter of roughing tool (roughing grindstone 162), the roughing path GT4 is found so as not to have a concave path smaller than the diameter of roughing tool.

Due to control of the control unit 50, the roughing process is performed based on the roughing path GT4, and then the lens position detecting unit 300F for mark detection is driven, whereby the actual movement positions of the marks M3 and M4 are searched for. The marks M3 and M4 are searched for within a range in which the "lateral deviation" and "rotational deviation" are predicted based on the respective initial positions of the marks M3 and M4. When the movement positions of the marks M3 and M4 are detected, the detection data ($\Delta x$, $\Delta y$) of "lateral deviation" and the angle $\Delta\alpha$ of "rotational deviation" are detected respectively as described above.

FIG. 12 is an example of a case where the detection angle $\Delta\alpha$ of "rotational deviation" becomes a predetermined angle $\alpha$1. F3*a* is a path obtained by moving the path F1 based on the detection data ($\Delta x$, $\Delta y$) of "lateral deviation". F3*b* is a path obtained by further rotating the path F3*a* on the chuck center C1, based on the detection angle $\Delta\alpha$ of "rotational deviation". The path F3*b* becomes the finishing path in which the "lateral deviation" and the "rotational deviation" have been corrected.

When the automatic correction of the "lateral deviation" and the "rotational deviation" is set, a path (not shown) obtained by adding the finishing lens margin $\Delta f$ to the final correction path F3*b* is found as the correction path of a second step of roughing process, and the roughing process is performed. After the completion of the roughing process, the finishing process is performed based on the correction path F3*b*. When the lens margin of a second step of roughing process is small, it is possible to omit the roughing process and perform only the finishing process.

In a case where the re-blocking is set as a countermeasure against the "lateral deviation" and the "rotational deviation", when it is determined that at least either of the "rotational deviation" or "lateral deviation" exceeds a predetermined allowable range, the display 5 displays a warning providing notification that the re-blocking is necessary as well as displaying which kind of "positional deviation" has occurred. Also, as described above, the operator takes the lens LE out of the device, and reattaches the cup Cu on the surface of lens LE in a predetermined procedure to perform processing again, whereby the processing in which the "positional deviation" has been corrected is performed.

Performing the correction processing as above makes it possible to avoid a result in which a lens becomes unusable, even when the "positional deviation" including the "lateral deviation" and the "rotational deviation" occurs.

To make it easy to detect the mark position, it is possible to make the marks M3 and M4 into a line-shaped mark extended in the direction connecting the positions PM3 and PM4. The line-shaped mark increases the efficiency of the mark detection in a single instance of a lens search. Regarding the line-shaped mark, if two line-shaped marks are also formed in the direction crossing (preferably, orthogonal to) the direction connecting the positions PM3 and PM4, it is possible to make it easy to detect the mark position and to improve accuracy in "positional deviation" detection.

Figure 13:
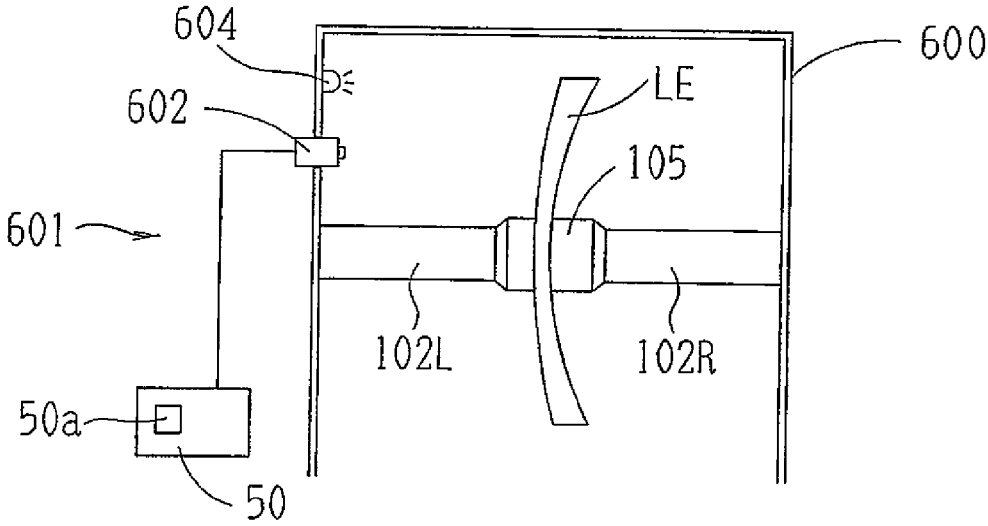
FIG. 13 is a configuration view of an optical mark detecting unit.

Various modifications can be made to the above embodiment. For example, as a mark detecting unit, an optical mark detecting unit 601 including an imaging unit taking the image of the marks M1 and M2 or the like can also be used. FIG. 13 is an example thereof; in the figure, in a processing chamber 600 in which the chuck shafts 102L and 102R are disposed, an imaging unit 602 is disposed at a position where the front surface of lens LE chucked in the chuck shafts 102L and 102R can be imaged. An illuminating unit 604 illuminating the lens LE is also disposed in the processing chamber 600. The image data imaged by the imaging unit 602 is transmitted to an image processing unit 50*a* of the control unit 50, whereby the position of the image-processed mark M1 or the like is detected.

Figure 14:
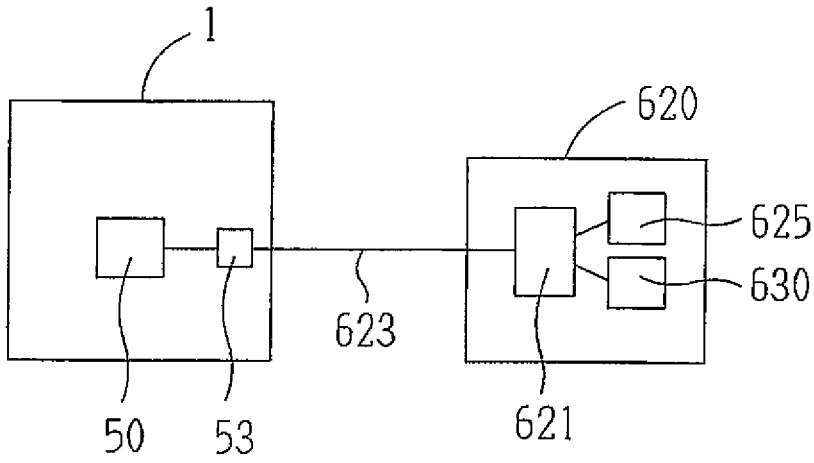
FIG. 14 is an example of a configuration in a case where a marking unit is installed in an auxiliary device.

A marking unit forming the marks M1 and M2 can not only be used with the drilling and grooving unit 400 or the like provided in the device 1, but also be provided in an auxiliary device. For instance, as shown in FIG. 14, there is a configuration in which a marking unit 630 is provided in a known blocking device 620 (refer to JP-A-2007-275998 (US 200722691 A1) for example) to which the target lens shape data and the layout data (data regarding positional relation between the target lens shape and the optical center of lens) can be input. The blocking device 620 is provided with an input unit 625 similar to the display 5 in FIG. 6, thereby enabling the input of target lens shape data and layout data, the input of processing conditions, and the selection of the layout mode or the water repellent lens mode. After inputting the data, the formation positions of the marks M1 and M2 as described above are determined by a control unit 621 of the blocking device 620, and the marking unit 630 is driven, whereby the marks are formed on the unprocessed lens LE. By a communication unit 623 including a communication line, for example, the position data of the marks M1 and M2, the target lens shape data, the layout data, and the selection data of the water repellent lens mode are input to a communication port 53 of the device 1. In this way, mark formation performed in the device 1 is omitted.

The marks M1 and M2 may also be marked with an attachable seal or a pen rather than processed on the lens surface. When the seal is used as the mark, it is possible to use the lens position detecting unit 300F for mark detection. If the optical mark detecting unit 601 as shown in FIG. 12 is provided, it is possible to use a mark marked with a pen or the like. When the mark marked with a detachable seal or an erasable pen, which can be removed after lens processing, is used, since it does not matter if the mark remains even after the finishing process on lens, the mark can be provided in the target lens shape. When the optical mark detecting unit is provided, it is possible to detect the initial position of the mark and input the detected position. Even in this case, the position of the mark is detected by the mark detecting unit provided in the device 1, and the rotational deviation or the lateral deviation is automatically detected in the device 1; therefore, an operator's burden is lessened, and the processing can be efficiently performed.

As described above, various modifications can be made to the invention, and the modifications are also included in the invention within the range of the same technical idea.

What is claimed is:

1. An eyeglass lens processing apparatus for processing a periphery of an eyeglass lens, comprising:

a pair of lens chuck shafts configured to chuck the lens;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit including a mark position inputting unit configured to input an initial position of a mark to be formed on the lens;

a mark position detector configured to detect a position of the mark formed on the lens;

a controller configured to control the periphery processing tool to perform a roughing process on the lens using the roughing tool and a finishing process using the finishing tool on the lens after the roughing process; and a positional deviation detector configured to control the mark position detector and detect a rotational deviation of the lens based on the initial position of the mark and the position of the mark detected by the mark position detector after the roughing process, wherein the controller obtains a roughing path which allows, even if the lens rotates on a chuck center of the lens chuck shafts by an angle as the rotational deviation at the time of the roughing process, and controls the periphery processing tool to perform the finishing process based on the target lens shape which is corrected in view of the angle, wherein the controller obtains an outermost path of the target lens shape and the initial position of the mark in a process in which the target lens shape and the initial position of the mark rotate on the chuck center by the angle, and computes the roughing path based on the obtained outermost path, and wherein the controller controls the periphery processing tool to perform the roughing process based on the computed roughing path.

2. The eyeglass lens processing apparatus according to claim 1, wherein the marking unit includes a marking tool configured to form the mark on a surface of the lens chucked by the lens chuck shafts, and the marking unit determines the initial position of the mark which is positioned outside the target lens shape, and forms the mark at the determined initial position using the marking tool.

3. The eyeglass lens processing apparatus according to claim 2, wherein the marking tool includes at least one of a drilling tool for forming a circle-shaped hole or a slot-shaped hole on the surface of the lens as the mark, and a grindstone or a cutter for forming a line-shaped scratch or groove on the surface of the lens as the mark.

4. The eyeglass lens processing apparatus according to claim 1 further comprising a selector including a first mode for processing a repellent lens in which water repellent material is coated on a surface, and a second mode for processing the lens which is not the repellent lens, wherein the marking unit and the mark position detector are operated if the first mode is selected.

5. The eyeglass lens processing apparatus according to claim 1, wherein if the detected rotational deviation exceeds an allowable range, the controller obtains a corrected target lens shape in which the target lens shape is corrected based on the detected rotational deviation, and controls the periphery processing tool to perform the finishing process based on the corrected target lens shape.

6. The eyeglass lens processing apparatus according to claim 1, wherein if the detected rotational deviation exceeds an allowable range, the controller obtains a corrected target lens shape in which the target lens shape is corrected based on the detected rotational deviation, obtains a corrected roughing path based on the obtained corrected target lens shape, and controls the periphery processing tool to perform the roughing process based on the corrected roughing path and the finishing process based on the corrected target lens shape.

7. The eyeglass lens processing apparatus according to claim 1 further comprising a warning unit configured to give a warning if the detected rotational deviation exceeds an allowable range, wherein the controller stops processing the lens if the detected rotational deviation exceeds the allowable range.

8. The eyeglass lens processing apparatus according to claim 1, wherein the mark is a hole or a line-shaped scratch or groove formed on the surface of the lens, the mark position detector includes a stylus contacting the surface of the lens chucked by the lens chuck shafts, and a sensor configured to detect movement of the stylus, and the mark position detector locates the stylus on the lens based on the initial position of the mark and detects the position of the mark based on an output signal of the sensor.

9. The eyeglass lens processing apparatus according to claim 1, wherein the mark position detector includes an imaging unit for imaging a surface of the lens chucked by the lens chucking shaft and detects the position of the mark by processing an output signal of the imaging unit.

10. The eyeglass lens processing apparatus according to claim 1 further comprising a lens chuck unit configured to chuck the lens by the lens chuck shafts, the lens chuck unit including a motor for moving one of the lens chuck shaft toward the other, wherein the lens chuck unit controls pressure for chucking the lens selectively to a first pressure suitable for processing the periphery of the lens and a second pressure lower than the first pressure, wherein the marking unit includes a marking tool for forming a lateral deviation mark on the surface of the lens for detecting a lateral deviation of the lens which occurs when the lens chuck shafts chuck the lens with the first pressure, wherein the marking unit determines an initial position of the lateral deviation mark which is positioned outside the target lens shape and forms the lateral deviation mark at the determined initial position of the lateral deviation mark using the marking tool, wherein the controller drives the motor so that the lens chuck shafts chuck the lens with the second pressure, and thereafter controls the marking unit to form the lateral deviation mark, and thereafter drives the motor so that the lens chuck shafts chuck the lens with the first pressure, and wherein the positional deviation detector controls the mark position detector and detects the lateral deviation of the lens based on the initial position of the lateral deviation mark and the position of the lateral deviation mark detected by the mark position detector after the lens is chucked with the first pressure.

11. The eyeglass lens processing apparatus according to claim 10, wherein if the detected lateral deviation exceeds an allowable range, the controller obtains a corrected target lens shape in which the target lens shape is corrected based on the detected lateral deviation, and controls the periphery processing tool to perform the roughing process and the finishing process based on the corrected target lens shape.

12. The eyeglass lens processing apparatus according to claim 10 further comprising a warning unit configured to give a warning if the detected lateral deviation exceeds an allowable range, wherein the controller stops processing the lens if the amount of the detected lateral deviation exceeds the allowable range.

13. An eyeglass lens processing apparatus for processing a periphery of an eyeglass lens, comprising:

a pair of lens chuck shafts configured to chuck the lens;

a lens chuck unit configured to chuck the lens by the lens chuck shafts, the lens chuck unit including a motor for moving one of the lens chuck shafts toward the other;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit including a mark position inputting unit configured to input an initial position of a mark to be formed on the lens for detecting a lateral deviation of the lens which occurs when the lens chuck shafts chuck the lens;

a mark position detector configured to detect a position of the mark formed on the lens;

a controller configured to drive the motor so that the lens chuck shafts chuck the lens and control the periphery processing tool to perform a roughing process on the lens using the roughing tool and a finishing process on the lens using the finishing tool after the roughing process; and a positional deviation detector configured to control the mark position detector and detect the lateral deviation of the lens based on the initial position of the mark and the position of the mark detected by the mark position detector after the lens is chucked with the first pressure.

14. The eyeglass lens processing apparatus according to claim 13, wherein the marking unit includes a marking tool for forming the mark on the surface of the lens, the marking unit determines an initial position of the mark which is positioned outside the target lens shape and forms the mark at the determined initial position using the marking tool, the lens chuck unit controls pressure for chucking the lens selectively to a first pressure suitable for processing the periphery of the lens and a second pressure lower than the first pressure, the controller drives the motor so that the lens chuck shafts chuck the lens with the second pressure, and thereafter controls the marking unit to form the mark, and thereafter drives the motor so that the lens chuck shafts chuck the lens with the first pressure, and the positional deviation detector controls the mark position detector and detects the lateral deviation of the lens based on the initial position of the mark and the position of the mark detected by the mark position detector after the lens is chucked with the first pressure.

15. The eyeglass lens processing apparatus according to claim 13, comprising a selector including a first mode for processing a repellent lens in which water repellent material is coated on a surface, and a second mode for processing the lens which is not the repellent lens, the marking unit and the mark position detector is operated if the first mode is selected.

16. The eyeglass lens processing apparatus according to claim 13, wherein if the detected lateral deviation exceeds an allowable range, the controller obtains a corrected target lens shape in which the target lens shape is corrected based on the detected lateral deviation, and controls the periphery processing tool to perform the roughing process and the finishing process based on the corrected target lens shape.

17. The eyeglass lens processing apparatus according to claim 13 further comprising a warning unit configured to give a warning if the detected lateral deviation exceeds an allowable range, wherein the controller stops processing the lens if the detected lateral deviation exceeds the allowable range.

18. An eyeglass lens processing apparatus for processing a periphery of an eyeglass lens, comprising:

a pair of lens chuck shafts configured to chuck the lens;

a lens chuck unit configured to chuck the lens by the lens chuck shafts, the lens chuck unit including a motor for moving one of the lens chuck shaft toward the other, the lens chuck unit controlling pressure for chucking the lens selectively to a first pressure suitable for processing the periphery of the lens and a second pressure lower than the first pressure;

a rotating unit configured to rotate the lens chuck shafts;

a periphery processing tool configured to process the periphery of the lens, the periphery processing tool including a roughing tool and a finishing tool;

a target lens shape inputting unit configured to input a target lens shape;

a marking unit which includes a marking tool for forming a mark on a surface of the lens for detecting a lateral deviation of the lens which occurs when the lens chuck shafts chuck the lens with the first pressure and a rotational deviation of the lens which occurs at the time of a roughing process using the roughing tool, determines an initial position of the mark which is positioned outside the target lens shape, and forms the mark at the determined initial position using the marking tool;

a mark position detector configured to detect a position of the mark formed on the lens;

a controller configured to drive the motor so that the lens chuck shafts chuck the lens and control the periphery processing tool to perform the roughing process on the lens and a finishing process on the lens using the finishing tool after the roughing process; and a positional deviation detector configured to control the mark position detector and detect the lateral deviation and the rotational deviation based on the initial position of the mark and the position of the mark detected by the mark position detector after the roughing process, wherein the controller drives the motor so that the lens chuck shafts chuck the lens with the second pressure, and thereafter controls the marking unit to form the mark, and thereafter drives the motor so that the lens chuck shafts chuck the lens with the first pressure, wherein the controller obtains a roughing path which allows, even if the lateral deviation of an amount and the rotational deviation of an angle occur, and controls the periphery processing tool to perform the finishing process based on the target lens shape which is corrected in view of the lateral deviation and the rotational deviation, wherein the controller obtains a first outermost path of the target lens shape and the initial position of the mark in a process in which the target lens shape and the initial position of the mark moves in a direction of the lateral deviation by the amount, and obtains a second outermost path of the target lens shape and the initial position of the mark in a process in which the obtained first outermost path rotates on a chuck center of lens chuck shafts by the angle, computes the roughing path based on the obtained second outermost path, and wherein the controller controls the periphery processing tool to perform the roughing process based on the computed roughing path.

19. The eyeglass lens processing apparatus according to claim 18, wherein if the detected lateral deviation exceeds an allowable range or if the detected rotational deviation exceeds an allowable range, the controller obtains a corrected target lens shape in which the target lens shape is corrected based on the detected lateral deviation or the detected rotational deviation, and controls the periphery processing tool to perform the roughing process and the finishing process based on the corrected target lens shape.

20. The eyeglass lens processing apparatus according to claim 18 further comprising a warning unit configured to give a warning if the detected lateral deviation exceeds an allowable range or if the detected rotational deviation exceeds an allowable range, the controller stops processing the lens if the detected lateral deviation exceeds the allowable range or the detected rotational deviation exceeds the allowable range.

* * * * *